United States Patent [19]

Tsugane

[11] 4,065,878

[45] Jan. 3, 1978

[54] AUTOMATIC DOOR OPENING AND SHUTTING DEVICE

[76] Inventor: Sachio Tsugane, 1627-28, Kamisoyagi, Yamato, Kanagawa, Japan

[21] Appl. No.: 678,940

[22] Filed: Apr. 21, 1976

[51] Int. Cl.[2] ..... E05F 15/14

[52] U.S. Cl. ..... 49/360

[58] Field of Search ..... 49/360, 139, 25, 263, 49/264, 282, 324, 327, 357, 347

[56] References Cited

U.S. PATENT DOCUMENTS

| | | | |
|---|---|---|---|
| 374,647 | 12/1887 | Albright | 49/327 |
| 2,871,009 | 1/1959 | Picatti | 49/360 X |
| 3,826,043 | 7/1974 | Seng | 49/360 |

*Primary Examiner*—Kenneth Downey
*Attorney, Agent, or Firm*—Michael J. Striker

[57] ABSTRACT

An automatic door opening and shutting device is disclosed. The present device comprises a support having an upper tube movable up and down toward a fixed lower tube, a driving source mounted on the upper tube of the support, a friction drive means for carrying out a friction drive of the door by transmitting power of the driving source to the door and a detecting means for detecting either person or vehicle coming in and out of the door, wherein a clockwise an anticlockwise actuation of or stop of the friction drive means can be controlled automatically by signals transmitted from the detecting means or the like.

7 Claims, 4 Drawing Figures

AUTOMATIC DOOR OPENING AND SHUTTING DEVICE

BACKGROUND OF THE INVENTION

In general, an automatic door opening and shutting device detects either person(s) or vehicle(s) coming in and out the door by a detecting means using a limit switch or a photoelectric tube. And by actuating an opening and shutting means with detecting signals, the door is opened or shut automatically. In case the automatic door is opened or shut by a friction drive system, the disadvantage is that power transmission on the friction surface tends to become irregular due to some shakes of the door being caused during the door opening or shutting, and then the automatic door is not actuated smoothly.

Further, in case the automatic door is switched to a manual operation by some accidents and other causes, it is forced to be opened or shut with a stronger force because a load of a friction drive means is applied to the friction surface of the door. Accordingly, it is not easy to open or shut smoothly by hand the door which ceased its automatic function.

For the sake of removing the aforegoing defects and disadvantages, the present invention has been achieved.

BRIEF SUMMARY OF THE INVENTION

It is therefore an object of the present invention to provide an automatic door opening and shutting device which can maintain constantly and appropriately a friction drive force transmitted to a friction surface of the door from a friction wheel of the door, and thereby can make it smooth to open or shut the door.

It is another object of the present invention to provide an automatic door opening and shutting device which can carry out an intermittent contact of the friction wheel to the friction surface of the door, by departing the former from the latter. As a result, in case the automatic door is changed to a manual operation, no load of the friction drive means is applied to the friction surface of the door, because the friction wheel can be departed therefrom.

It is another object of the present invention to provide an automatic door opening and shutting device which can be operated with a remote control by setting somewhere indoors a certain switch or button for operating the above device.

Other and further objects and features of this invention will appear more fully from the following description of embodiments with reference to the accompanying drawings.

DETAILED DESCRIPTION OF THE INVENTION

Figure 1:
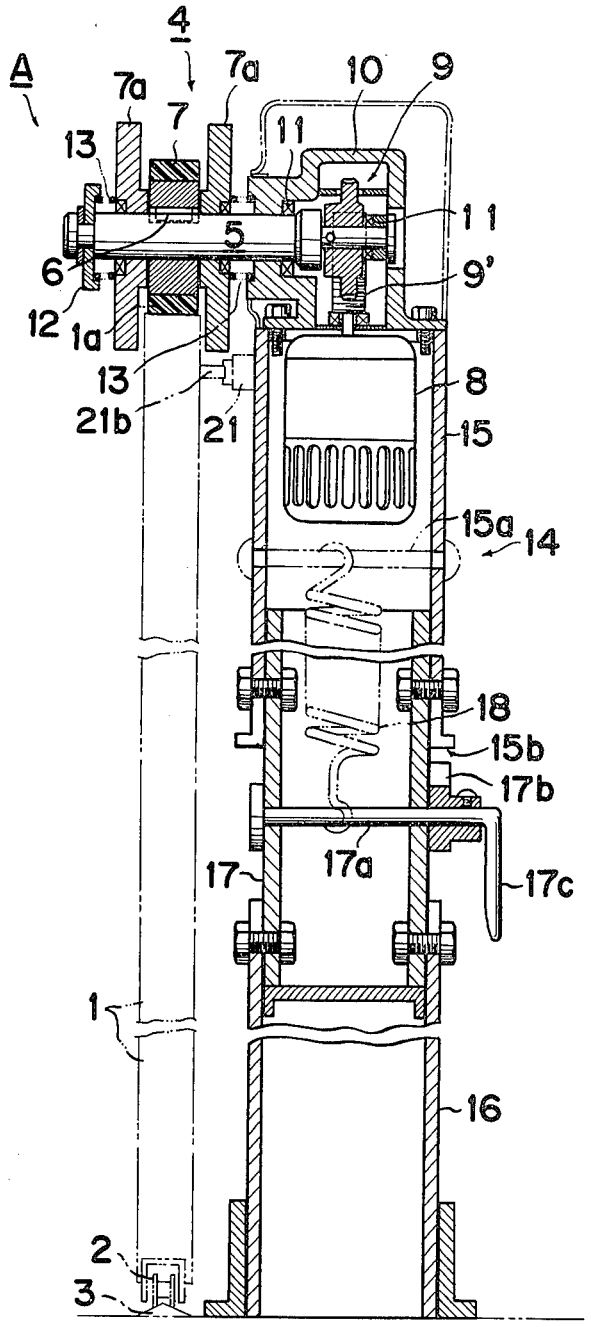
FIG. 1 is a section view of an automatic door opening and shutting device of the present invention.

Referring first to FIG. 1, there is shown a section view of an automatic door opening and shutting device A. A door 1 has a wheel 2 attached to the underside thereof, and can be moved on a rail 3. Also, the door 1 has a friction surface 1*a* on the top thereof.

Numeral 4 designates a friction drive means comprising a friction wheel 7 mounted rotatably on the periphery of an output shaft 5 by way of a sliding key 6, a pair of guide wheels 7*a*, 7*a* provided at both sides of the friction wheel 7, a motor 8 rotatable clockwise or anticlockwise and a power transmission means 9 for rotating the friction wheel 7 with a given torque which is connected to the motor 8 and the output shaft 5 as well. Under such a structural condition of the friction drive means 4 the door 1 can be moved automatically on the rail 3 by way of the friction surface l*a* thereof.

Figure 3:
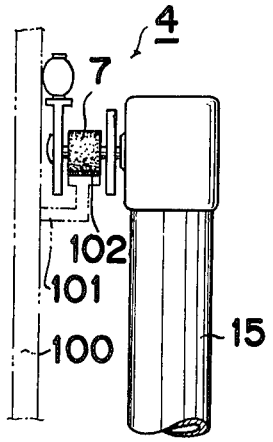
FIG. 3 is a side view of a key part showing an embodiment of the present invention.

It is not always necessary to provide the friction surface l*a* exclusively on the top of the door 1. In FIG. 3 a door 100 is driven by way of a friction surface 102 of a L-type support 101 which is projecting from a side of the door 100, so that the friction drive means can be installed to a manual-type door, and thereby the door can be changed to an automatic control. Also, a worm gear means 9' in the power transmission means 9 can be replaced with an overload protecting means, whereby a power transmitting force can be slipped in case a resistance force of more than a given rate is applied to the door 1.

One end of the output shaft 5 at the motor side is supported by ball bearings 11 inside of a gear casing 10, while another end of the output shaft 5 is bolted by a locking panel 12 so that the friction wheel 7 and a pair of guide wheels 7*a*, 7*a* can not be dismounted. And balance springs 13, 13 are provided between the friction wheels 7*a* and the gear casing 10 as well as between the friction wheel 7*a* and the locking panel 12. As a result, the friction wheel 7 is slidable stably on the output shaft 5.

The friction drive means 4 is fixed with an upper tube 15 of a support 14 which is fixed standing adjacent to the rail 3, and the upper tube 15 is linked with an intermediate tube 17 and moved upwardly or downwardly together with the intermediate tube 17. And a pulling spring 18 is bridged between a bean 15*a* of the upper tube 15 and the beam 17*a* of the intermediate tube 17. Thus, by pulling the spring 18, the friction wheel 7 can be pressed to the friction surface 1*a* of the door 1. Accordingly, its pressing is the resultant force of the weight of structure above the intermediate tube plus the pulling force of the spring 18. Further, in order to control the contacting pressure, a compression spring can be installed between the fixed lower tube 16 and the intermediate tube 17.

Numeral 17*b* designates an arm bolted to the beam 17*a* of the intermediate tube 17. By turning upwardly a handle 17*c* formed at one end of the beam 17*a*, the arm 17*b* is contacted to the underside 15*b* of the upper tube 15, and thereby the upper tube 15 is lifted. Subsequently, the friction wheel 7 can be departed with a given height from the friction surface 1*a* of the door 1. Then, it is the very important thing that each underside of the two guide wheels 7*a*, 7*a* should not be over the friction surface 1*a*. In other words, the friction surface should be always enclosed by the guide wheels 7*a*, 7*a*.

Figure 2:
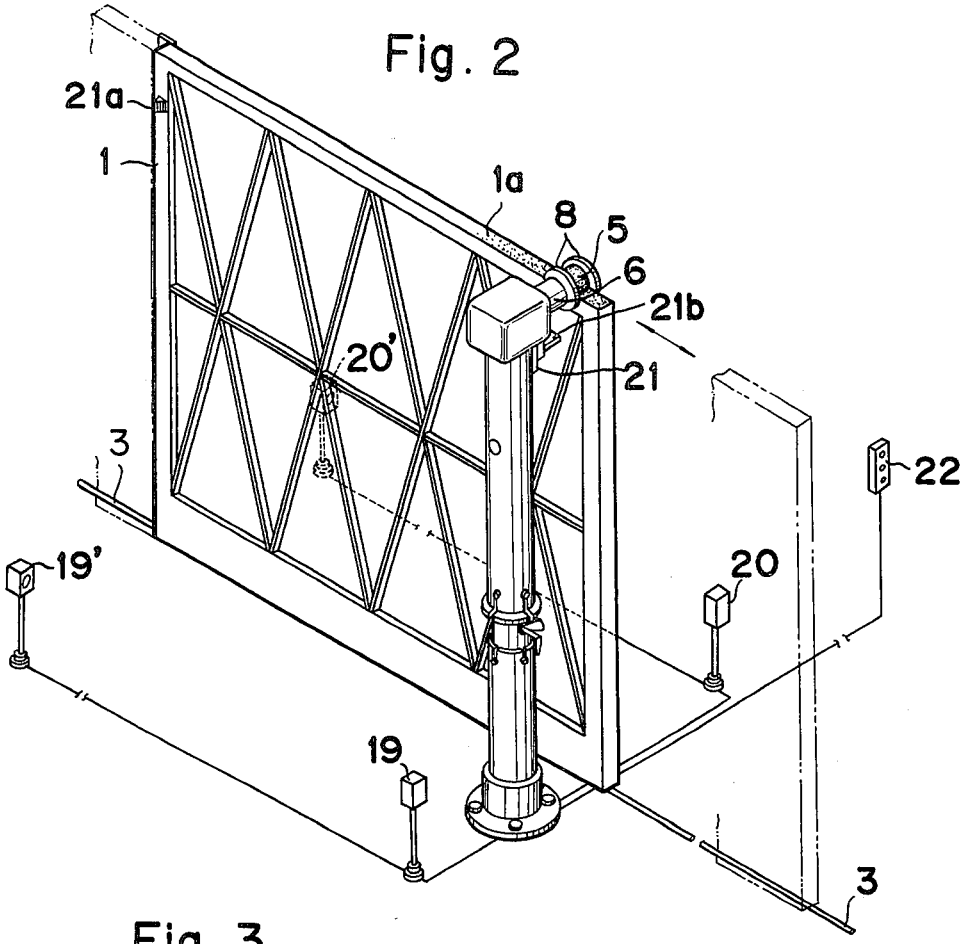
FIG. 2 is a perspective view of the divice of FIG. 1.

Referring to FIG. 2, numerals 19, 19' and 20, 20' designate detecting means which can detect any person or vehicle approaching thereto, and transmit signals to the automatic door opening and shutting devise A. Numeral 21 designates a limit switch. When the door 1 is set to the "open" position or to the "shut" position, the limit switch 21 is actuated by two contacting members 21*a*, 21*b*.

Numeral 22 designates a button for operating remotely the device A. For instance, if the button is set somewhere indoors, the automatic device A can be operated by a remote control. Further, as another example of the remote control, by detecting sound or light or waves transmitted from an object approaching to the door, it is advisable to provide a switching means which can transmit instruction signals for actuating the motor 8.

Under the aforegoing circumstances, if no instruction signals are transmitted from the detecting means 19, 19' and 20, 20' or by the operating button 22, the door is always shut. In this situation, if the above detecting means detect either person or vehicle coming in or out of the door and then signals are transmitted, the motor 8 is rotated clockwise. Subsequently, the friction wheel 7 is rotated with a given torque by way of the power transmission means 9. Then, the door 1 starts to move on the rail 3 by means of the rotation of the friction wheel 7 on the friction surface 1*a* of the door 1, and is being opened unless another signal is input. As described previously, in case the overload protecting means is employed, the door 1 stops as far as the resistance force of more than a given rate is applied to the door.

When the door 1 is being moved on the rail 3, there is the possibility that it may be shaken a certain bad condition of the rail 3 or the like. However, such shaking of the door 1 can be avoided since the friction surface 1*a* of the door 1 is enclosed at both sides thereof with a pair of guide wheels 7*a*, 7*a*, and they are supported by balancing springs 13, 13. Accordingly, the friction surface 1*a* of the door 1 and the friction wheel 7 are always protected stably and never be disturbed by such shaking. That is, since the friction wheel 7 is always driven appropriately on the friction surface 1*a*, the door 1 is movable stably with a constant speed. The aforementioned operation is also applicable to an embidiment of FIG. 3.

In case one opens or shuts the door 1 by hand, the following step is taken: First, by turning the handle 17*c* of the intermediate tube 17 upwardly, the upper tube 15 is lifted by the arm 17*b*. Subsequently, the friction wheel 7 of the friction drive means 4 is also lifted and departed from the friction surface 1*a*. In this way, the power transmission to the friction surface is cut off so that the door 1 can be operated by hand without any load of the friction drive means 4. Further, it is advisable to set up or down the upper tube 15 by means of a pneumatic system. If there is provided a special detecting means which can detect some obstacles on the rail 3 on which the door is moving, the moving door 1 can be automatically stopped by connecting the said detecting means to the pneumatic system.

In case the door 1 capable of performing the aforementioned function is placed in the "open" position, the contacting member 21*a* thereof pushes the limit switch 21 of the upper tube 15, and then the instruction signals are transmitted to the motor 8. Consequently, the door 1 is driven by friction. In case the door 1 is placed in the "shut" position, the contacting member 21*b* thereof pushes the limit switch 21.

Figure 4:
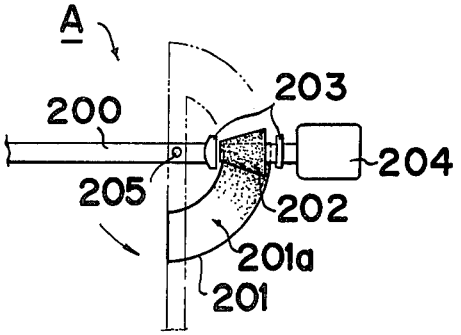
FIG. 4 is a plan view of another embodiment of the present invention.

The device according to the present invention is applicable not only to the door 1 movable on the rail which is disclosed in the aforementioned embodiment, but also to various types of doors. Another example is shown in FIG. 4. In FIG. 4 numeral 200 designates a door having an arc-type arm 201 on which surface is formed a friction surface 201*a*. And a friction wheel 202 can be pressed to or departed from the friction surface 201*a*. Further, the arc-type arm 201 is protected by a pair of guide wheels 203, 203. Under such a protection, the friction surface 201*a* is driven by the friction wheel 202 reciving power from a drive source 204. As understood in this example, the device according to the present invention is applicable to various types of doors including heavy or large doors etc. both indoors and outdoors.

As described previously, the friction drive is safely protected on the friction surface of the door, even if the door is shaken during its opening and shutting. Further, since the friction wheel can be departed from the friction surface, the automatic door can be easily switched to a manual operation. In a conventional type of automatic door actuated by friction drive, when it is switched to a manual operation, it is not easy to open or shut the door by hand, because there takes place increasingly a certain load caused by contacting the friction wheel with the friction surface of the door. The device according to the present invention has completely removed the disadvantage mentioned above, thanks to its simple mechanical structure.

What is claimed is:

1. A device for opening and shutting a door, comprising a support having a lower tube and an upper tube vertically movable relative to the lower tube; a driving source mounted on the upper tube of the support; friction drive means for carrying out a friction drive of the door by transmitting power of the drive source and adapted to move clockwise or anticlockwise or to stop, the friction drive means having a friction wheel movable between a first position in which the friction wheel frictionally engages a friction surface of the door so that load is applied to the latter and a second position in which the friction wheel is disengaged from the friction surface of the door so that no load is applied to the latter, a pair of guide wheels for securing the friction wheel against shaking of the door caused during its opening and shutting and for thereby maintaining appropriate power transmission of the friction wheel to the friction surface, the friction wheel being disengageable from the friction surface of the door to a distance corresponding to the difference between the radii of the guide wheels and the radius of the friction wheel, and a power transmission means installed between a drive source and an output shaft for rotating the friction wheel with a given torque; means for moving the friction wheel at least from the first position to the second position in which the friction wheel is disengaged from the friction surface of the door so that no load is applied to the latter whereby to permit opening or shutting of the door by hand; guide rails for guiding a side of the door which is spaced from the friction surface thereof, during opening or shutting of the door; and stop means for stopping the opening or shutting movement of the door when a resistance force applied to the door surpasses the friction drive force transmitted by said friction wheel to the friction surface.

2. The device as defined in claim 1, and further comprising means for remotely controlling operation of the driving source for rotating the friction wheel, at any preferred time and at the place distant from the door.

3. A device for opening and shutting a door having a part provided with an edge face which extends between two lateral faces, comprising friction drive means for frictionally moving a door between an open and a shut position, said drive means having a friction wheel rotatable about an axis extending across said edge face substantially transversely said lateral faces and said friction wheel being movable betwen a first position in which it is pressed against said edge face to thereby open or close said door by rotation of said friction wheel, and a second position in which it is disengaged from said edge face so that no load is applied to the door and the same can be easily opened or shut by hand; a pair of guide wheels spaced from one another along said axis and located at opposite axial sides of said friction wheel each adjacent the respective lateral face of the latter so as to prevent axial displacement of said friction wheel and to thereby suppress shaking of the door during opening and shutting of the latter; and a drive source for driving said friction drive means.

4. The device as defined in claim 3, wherein said friction wheel is mounted on a rotatable shaft, and said guide wheels are mounted on said shaft for joint rotation with said friction wheel.

5. The device as defined in claim 3, wherein said guide wheels are axially movable; and further comprising springs pressing each of said guide wheels against the respective lateral face of said friction wheel.

6. The device as defined in claim 3, wherein said part is located adjacent an upper portion of the door, said guide wheels having portions located at opposite sides of said part and each adjacent the respective lateral face surface of said part so as to limit transverse displacement of said upper portion of the door.

7. The device as defined in claim 6, further comprising a guide rail adjacent a lower portion of the door and extending along the entire path of the door during opening and shutting of the latter, said guide rail engaging and guiding said lower portion of the door along said entire path so as to prevent transverse displacement of said lower portion of the door.

* * * * *